US009567045B2

(12) United States Patent
Thom et al.

(10) Patent No.: US 9,567,045 B2
(45) Date of Patent: Feb. 14, 2017

(54) MARINE LIFTING VESSEL

(71) Applicants: Donald Scott Thom, Auckland (NZ); Norman Clifford Smith, Isle of Wight (GB)

(72) Inventors: Donald Scott Thom, Auckland (NZ); Norman Clifford Smith, Isle of Wight (GB)

( * ) Notice: Subject to any disclaimer, the term of this patent is extended or adjusted under 35 U.S.C. 154(b) by 0 days.

(21) Appl. No.: 14/915,853

(22) PCT Filed: Sep. 9, 2014

(86) PCT No.: PCT/NZ2014/000195
§ 371 (c)(1),
(2) Date: Mar. 1, 2016

(87) PCT Pub. No.: WO2015/038009
PCT Pub. Date: Mar. 19, 2015

(65) Prior Publication Data

US 2016/0194060 A1 Jul. 7, 2016

(30) Foreign Application Priority Data

Sep. 10, 2013 (NZ) ..... 615354
Mar. 20, 2014 (NZ) ..... 622736

(51) Int. Cl.

| | |
|---|---|
| ***B63B 7/00*** | (2006.01) |
| ***B63B 35/44*** | (2006.01) |
| ***B63B 1/10*** | (2006.01) |
| ***B63B 35/32*** | (2006.01) |

(52) U.S. Cl.
CPC ..... *B63B 35/44* (2013.01); *B63B 1/10* (2013.01); *B63B 7/00* (2013.01); *B63B 35/32* (2013.01)

(58) Field of Classification Search
CPC ..... B63C 1/06; B63C 3/06; B63B 7/02; B63B 7/04
See application file for complete search history.

(56) References Cited

U.S. PATENT DOCUMENTS

| | | | | |
|---|---|---|---|---|
| 87,291 A * | 2/1869 | Richardson | B63C 1/02 114/46 |
| 3,638,437 A * | 2/1972 | Fukuda | B63B 9/04 114/45 |
| 4,092,790 A * | 6/1978 | Sonerud | E02F 9/06 114/53 |

(Continued)

FOREIGN PATENT DOCUMENTS

WO WO2013-052007 4/2013

OTHER PUBLICATIONS

International Search Report, PCT/NZ2014/000195, Dec. 23, 2014.

*Primary Examiner* — Benjamin Fiorello
(74) *Attorney, Agent, or Firm* — Young & Thompson

(57) ABSTRACT

For a self-powered marine lifting vessel or catamaran having static buoyancy, a working deck is forcibly raised or lowered by flexing or extending each of a plurality of articulated pairs of fixedly mounted support beams connecting each hull and the deck. One version uses locally applied forces at the joints from adjacent hydraulic cylinders, incidentally causing the hulls to rotate about their axes. Another version forces the hulls to rotate axially from a non-rotating aft inter-hull linkage. Applications include routine harbor maintenance and hull cleaning, then emergency marine pollution including oil cleanup at a polluted site.

17 Claims, 3 Drawing Sheets

(56) References Cited

U.S. PATENT DOCUMENTS

| | | | | |
|---|---|---|---|---|
| 5,792,350 | A | 8/1998 | Sorley et al. | |
| 6,032,601 | A * | 3/2000 | Gates | B63C 1/02 114/45 |
| 6,131,528 | A * | 10/2000 | Meek | B63C 1/02 114/44 |
| 6,477,968 | B2 * | 11/2002 | Powell | B63C 1/04 114/263 |
| 7,419,329 | B1 | 9/2008 | Tafoya | |
| 7,527,014 | B2 * | 5/2009 | Hey | B63B 17/02 114/361 |
| 9,132,897 | B2 * | 9/2015 | Barnes | B63B 43/04 |
| 2002/0132537 | A1 | 9/2002 | Hey | |
| 2013/0213897 | A1 | 8/2013 | Jauncey et al. | |

* cited by examiner

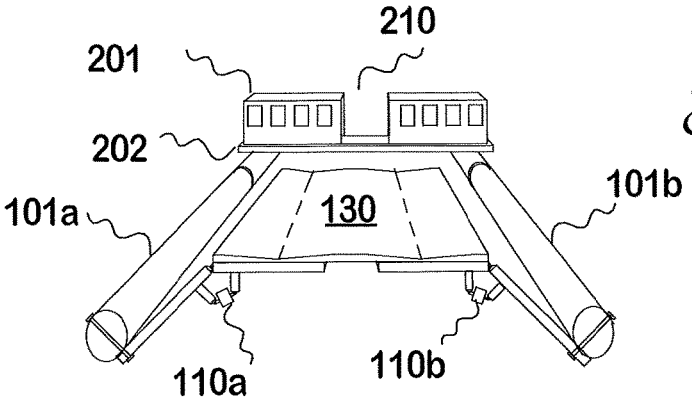
Fig 2a
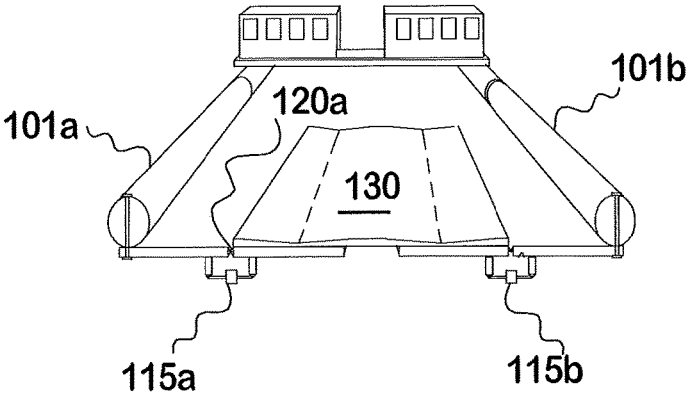
Fig 2b
Fig 2c
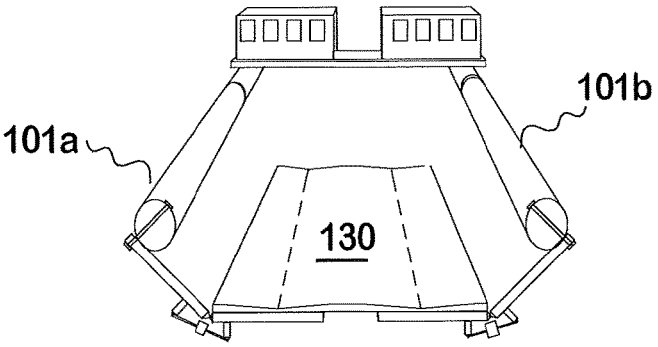
Fig 2d
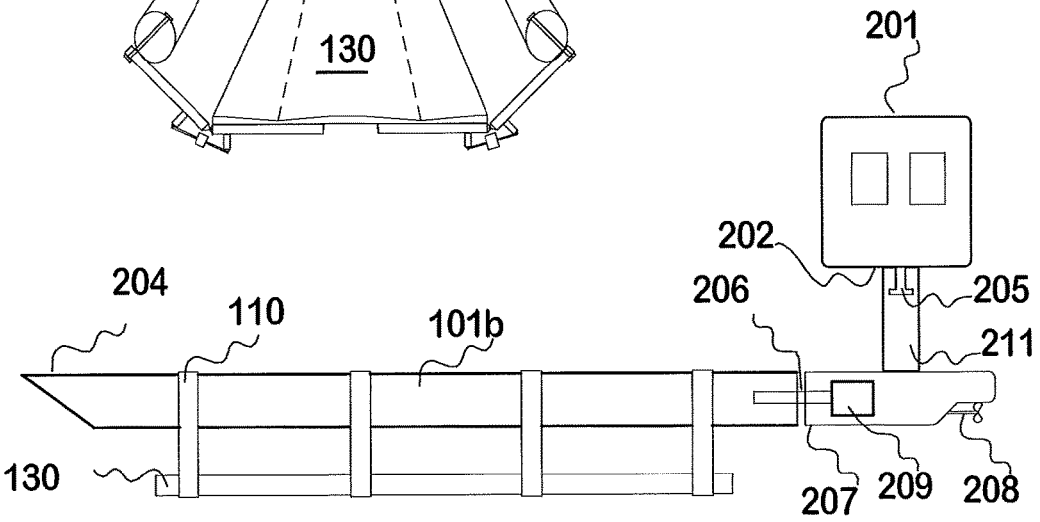

MARINE LIFTING VESSEL

BACKGROUND OF THE INVENTION

Field of the Invention

The invention relates to a vessel suited to lifting and lowering floating vessels and other loads while relying mainly if not entirely on static buoyancy, to transporting loads over bodies of water, and to an application of that vessel to marine salvage and cleanup operations including removal of oil from an oil spill.

"TOMCAT" as used herein refers to a utility catamaran as described, having a rigid deck, static buoyancy, and mechanical actuator means to raise or lower the deck with respect to the water line. For example a mid-range seagoing size has two 30 m hulls and a displacement of 30 tonnes. The dimensions of the TOMCAT may be scaled up or down, to suit any application.

Description of the Related Art

90% of internationally traded goods are carried on merchant ships that require periodic hull maintenance and anti-fouling treatment, and must be raised out of the water for such work to be done. In the same way, recreational vessels too large to be taken from the water on an automobile trailer require lifting and hull maintenance.

Marine salvage and clean-up further requires reliable means for carrying and lifting loads, often far from land. This presents the challenge of lifting loads from a floating platform whose stability is not assured. Existing means for marine lifting such as floating dry-docks typically use variable buoyancy. But variable buoyancy lifts inherently have poor stability, especially if the buoyant effect is affected by submersion pressure.

Many maritime events; deliberate or accidental, result in petroleum-related compounds polluting a body of water. Very large incidents are not uncommon. Spilled oil, lost containers, and other environmental threats demand an effective clean-up response. For example the 2010 Deepwater Horizon spill in the Gulf of Mexico, and the 2011 Rena spill of oil and shipping containers off the coast of Tauranga in New Zealand. With increased interest in offshore drilling, there is a continuing risk of further spills. Much harm including to wild life and to the fishing industry is caused when spilled oil reaches coastlines. The current state of the art in oil recovery relies on very large vessels which are kept in remote countries, or use of relatively small skimmers.

PRIOR ART

Example prior art publications include California "Clean Seas LLC" which describe monohull vessels eg "Ocean Scout" see www.cleanseas.com. These carry forward looking infra-red radar and 1,500 feet of (floating) boom. This citation is of particular use by describing how an organisation for oil spill remediation operates.

GB 1302386 "Watercraft especially useful for the recovery of oil" (1973) is a manoeuvrable water jet-propelled catamaran. No liftable deck is described.

GB 1356787 "Boat" (1974) to British Petroleum Company Limited is a catamaran including a rigid deck; the rear part of which may be let down into the sea as a movable lifting platform. Inflatable hulls are preferred for easier transport to an oil spill site. A containment boom may be laid on to the water from the movable lifting platform; from the stern of the catamaran.

GB 1515592 "A floating oil storage vessel for recovering oil spills" (1975) describes a barge for holding oil, from which two booms are each pulled by a tug, to encompass a spill and allow it to flow into an intake on the barge. The system moves with respect to the surface.

There is a need for a marine lifting vessel, for which a catamaran configuration is suited by virtue of stability, that has a deck of controlled height, to serve as a lifting platform including the lifting of vessels for hull maintenance, a submersible platform, and a platform from which to carry out salvage and marine remediation work including recovery of spilt oil.

There is a need to organise a pool of financially self-supporting versatile harbour maintenance and service vessels with an experienced crew, ready to be converted into salvage and oil disposal vessels at a moment's notice.

BRIEF SUMMARY OF THE INVENTION

An object of the present invention is to provide a utility vessel capable of raising and lowering loads. More particularly, an object of the present invention is to provide a multi-functional utility catamaran having a liftable and lowerable deck, and another object is to provide a utility vessel capable of becoming a rescue vessel or the reverse, or at least to provide the public with a useful choice.

In a first broad aspect the invention provides a marine lifting vessel or catamaran having two buoyant hulls each provided with static buoyancy; characterised in that the catamaran has a rigid working deck having a top, an underneath, two sides, a bow aspect and a stern aspect and the deck is movably and symmetrically supported along each side from the adjacent hull by a plurality of intermediate beams arranged in a parallel array thereby indirectly securing one hull to the other; each intermediate beam being comprised of two beams (herein identified as a "hull beam" and a "deck beam"), pivotally joined together at their adjacent ends and having a substantially horizontal axis of rotation, thereby forming a lifting joint; the far end of each beam being fixedly attached to the hull and to the deck respectively; wherein each joint sharing a common axis of rotation with the joints of the other intermediate beams; the catamaran including joint control means or joint actuator means to forcibly changet; all joint control means being under co-ordinated control of a controller; so that, when in use, a height of the rigid deck in relation to a water line can be altered by the controller by forcibly causing the angles of a plurality of the joints to change; thereby either lifting the deck higher above the water line, or lowering the deck to or below the water line.

Preferably the angles at the joints between the hull beam and the deck beams can be forced to assume an angle in a range including between an acute angle and an obtuse angle as shown in FIGS. 1*a* through 1*d*.

In a related aspect each joint control means or joint actuator means includes a powered actuator selected from a range including hydraulic cylinders, reversible hydraulic cylinders, linear actuators in conjunction with mechanical ratchets, mechanically driven screw and nut actuators, ropes or cables pulled by one or more winches, and screw and cog wheel actuators.

In a subsidiary aspect, the lifting means attached to each lifting joint can be separately actuated by a control mechanism, so that when in use adjustment of individual or grouped actuators can compensate for uneven loading of lift joints to keep a load substantially level.

In a further related aspect, each joint control means comprises a hydraulic piston operable in both extension and in retraction directions that is connected by means of a rigid side arm set off both horizontally and vertically from the pivoting join, so that when in use the piston can exert torque around the pivoting join through at least 90 degrees of rotation.

In a second related aspect, an aft portion of each hull is pivotally mounted by means of a shaft in line with and fixed to the forward remainder of each hull, the aft portion of each hull is prevented from rotation by a non-rotating, bridging linkage to the opposite hull which permits relative sideways movement to occur, and in order to provide the deck with a lifting or a lowering force both shafts are caused to rotate each in an opposite direction with respect to the aft section by a motor within each aft section coupled to each shaft so that, when in use, the forward hulls are forced to rotate through a defined angle and the deck and hull beams are forced to follow.

In an option the hulls provide protection and support for powered propulsion means, selected from a range including screw propellers and water jets.

Preferably the bridging linkage supports a non-rotating control deck.

Preferably the control deck comprises a foundation on which to build a superstructure and from which to support powered propulsion means.

In a first option, each buoyant hull has a nominally circular cross-section and the waterline is not substantially altered by lifting or lowering of the deck.

In a second option, each buoyant hull has a non-circular cross-section selected in order to provide a narrower, deeper cross-section when the deck is not lifted out of the water, and a wider and more shallow cross-section when the deck is lifted out of the water, thereby increasing the stability of the lifted deck with reference to the water line.

Preferably the deck is provided with vessel lifting supports and frames and the catamaran is capable of lifting a vessel out of the water by a process of (a) submerging its deck, (b) placing its deck beneath a vessel to be lifted and attaching said lifting supports and frames, and (c) forcibly causing the angles of a plurality of the joints to bend in a more upward direction, thereby lifting the deck and the supported vessel above the waterline and emulating an action of a dry dock.

In a second broad aspect the catamaran is provided from time to time with accessories capable of collecting floating materials from a surface of a body of water and of placing said floating materials into a container for later disposal; wherein the capability of the catamaran for varying the height of the deck in relation to the waterline provides an enhanced capability for collection of said floating materials, and wherein the floating materials include spilt petroleum products.

Preferably the catamaran is provided with one or more remotely controllable daughter tug vessels or tugs capable of pulling a floating boom around an area on a surface of the body of water under remote control so that said floating materials may be contained; each tug including an engine, propeller and rudder, means for maintaining a positive pressure inside an inflatable boom, and means for receiving control signals by wireless.

Optionally the tug or tugs are crewed by one or more persons.

In a third broad aspect the catamaran is capable of being disassembled into component parts including hulls or hull segments, linking beams, a rigid deck or parts thereof, in order that it may be transported by non-maritime transport means selected from a range including road, rail and air transport, and reassembled adjacent a launch site, including but not limited to marine salvage and/or an oil spill.

The description of the invention to be provided herein is given purely by way of example and is not to be taken in any way as limiting the scope or extent of the invention. Throughout this specification unless the text requires otherwise, the word "comprise" and variations such as "comprising" or "comprises" will be understood to imply the inclusion of a stated integer or step or group of integers or steps but not the exclusion of any other integer or step or group of integers or steps. Each document, reference, patent application or patent cited in this text is expressly incorporated herein in their entirety by reference. Reference to cited material or information cited in the text should not be understood as a concession that the material or information was part of the common general knowledge or was known in New Zealand or in any other country.

BRIEF DESCRIPTION OF THE DRAWINGS

FIG. 2: (as FIGS. 2*a*, 2*b*, 2*c*) shows forward end perspective diagrams of a TOMCAT respectively above, just under the surface of, and deep under a water surface.

FIG. 2*d* is a side elevation of FIG. 2*c*.

DETAILED DESCRIPTION OF THE PREFERRED EMBODIMENTS

Example 1

Marine Lift or Floating Dock

See FIG. 1, diagrams of cross-sections through a marine lift or TOMCAT (100) with its deck 130 at a variety of lift positions. The lifting floats or hulls (101) having static buoyancy are each cut by a water plane (dashed line 102).

Figure 1A:
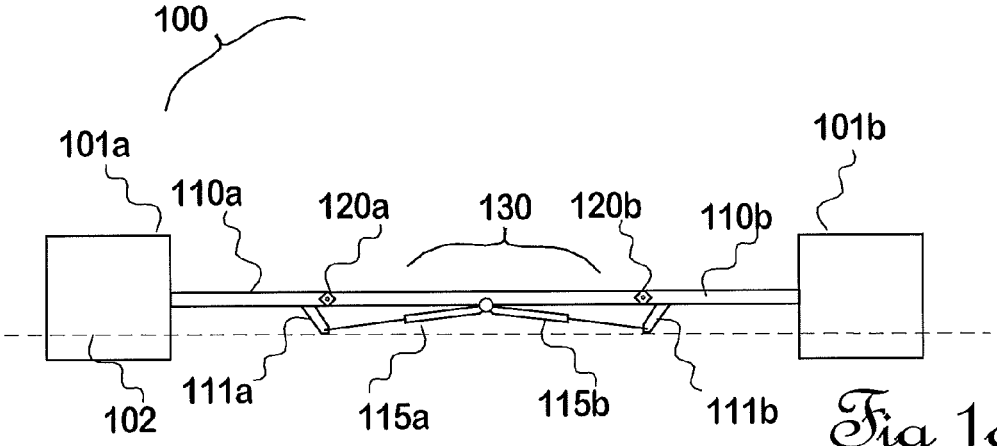
FIG. 1: (as FIGS. 1*a*, 1*b*, 1*c* and 1*d*) shows conceptual schematics of a transverse vertical section through the TOMCAT with the deck respectively parallel to, lowered into, partly raised above, and fully raised above a water surface.

A rigid floating deck 130 is shown in a horizontal attitude although it may be set to have a slope by a person operating the TOMCAT. The deck is supported by buoyant hulls through a set of beams 110*a*, pivotally connected at 120*a* to the deck 130 and also pivotally connected at 120*b* to deck beams 110*b*. In this version, beams 110*a* and 110*b* are firmly fixed to hulls 101*a* and 101*b*, and operation of the marine lift causes the hulls to rotate. (It will be noted that FIG. 1*c* shows the hulls more deeply immersed than in FIG. 1*b*, since the deck itself might contribute buoyancy, if made of wood or including hollow enclosures such as tanks.)

A preferred powered actuator used to provide a powered lifting mechanism comprises a pair or a series of pairs of pivotally mounted hydraulic pistons 115*a* and 115*b*; preferably capable of being powered in either push or pull directions so as to cause the joint to bend either side of straight, as required. For example the pistons are placed so as to push or pull against struts 111*a* and 111*b* in order to provide a moment about pivots 120*a* and 120*b* and to force the angle formed between beam 110*a* (or 110*b*) and deck 130 to change from acute to obtuse as shown in FIGS. 1*a* (straight), 1*b* (bent upward, causing the deck to sink relative to the water level,) 1*c* (bent downward, thereby raising the deck 130 above the water level 102, or even, as in FIG. 1*d*, raising the deck some distance above the water. In the extreme position of FIG. 1*d* there might be some question of stability since the two hulls have been brought close together. All other configurations shown enjoy the stability of a catamaran design. Repetition along the length of the TOMCAT deck provides useful overall lifting capacity given limitations of individual hydraulic pistons divided by the leverage of struts 111*a* and 111*b*.

It should be noted that a preferred selection of hydraulically powered equipment may differ from that shown, which is illustrative. Optimised solutions, as designed by those skilled in providing optimised hydraulic actuators and controllers, and may depend on availability, power, reach, and optimising the strength of the parts of the TOMCAT on which the hydraulic cylinders are mounted and exert forces. See also lines 220-239.

Figure 3:
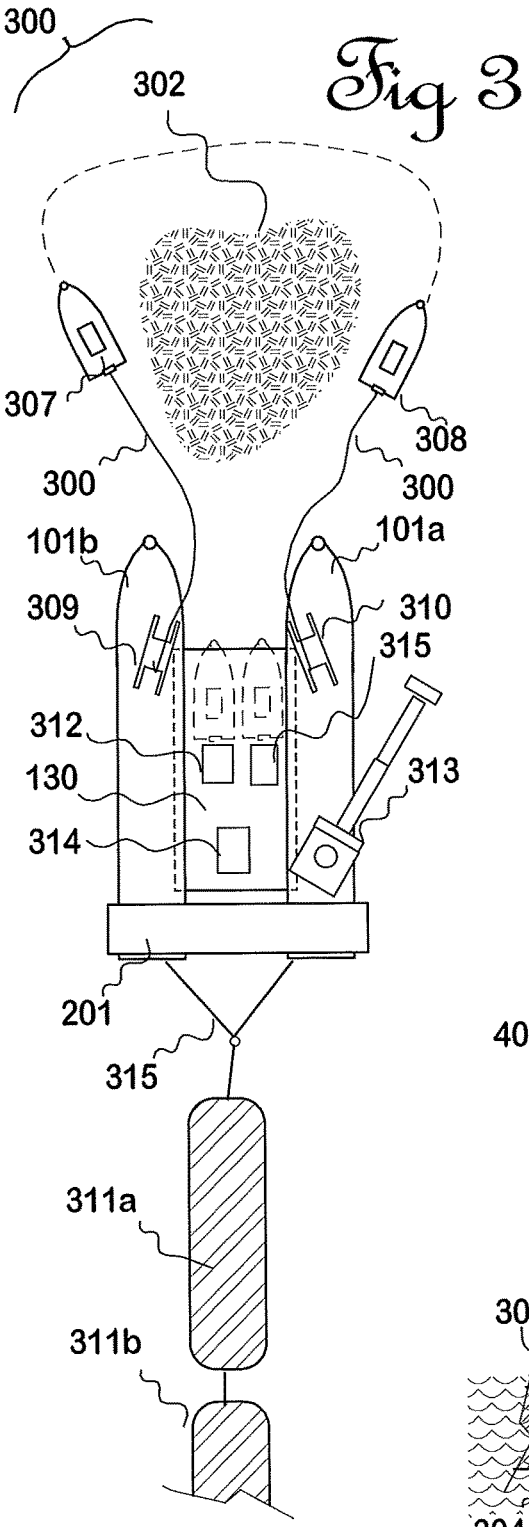
FIG. 3: is a plan view of a TOMCAT in the process of trapping a small oil spill on a body of water, using two remotely controlled tugs each according to the invention.

FIG. 1 does not include the usual accessories that might be used when lifting a monohull vessel out of the sea or other body of water. The deck (130) may hold keel blocks, frames, props and vertical supports as are common-place for a particular type of boat. The square hull sections shown provide a slight keel effect for the hulls in case the TOMCAT is used to transport cargo in any mode but with least drag when set according for FIG. 1*c*. Preferably the TOMCAT is provided with at least one small hydraulically driven crane FIG. 3, 313 (for example "Hiab" type) for use when managing heavy objects, or for self-assembly or disassembly (see later).

Figure 1B:
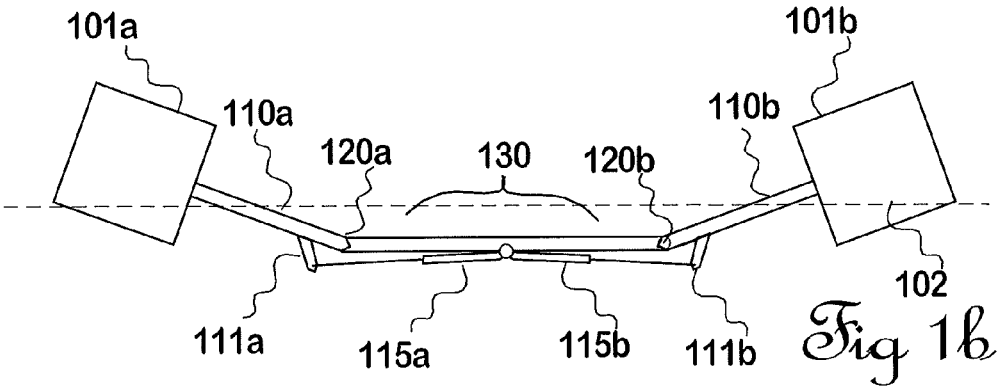
Figure 1C:
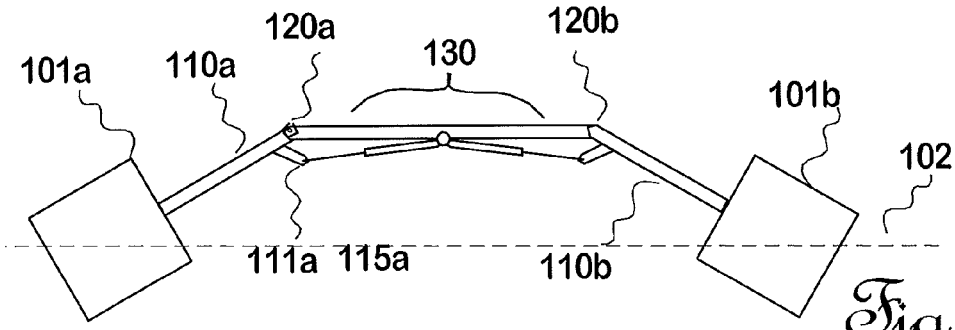
Figure 1D:
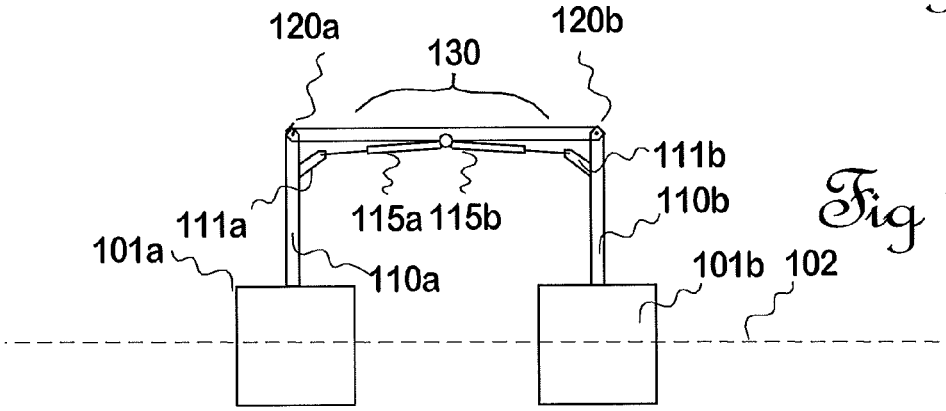

The configuration of FIG. 1*b* is appropriate for engaging with a floating load such as a boat, seaplane, or buoy. FIG. 1*c* shows how the load can be lifted completely out the water, subject of course to the usual requirements of displacement.

The provided lift floats provide a relatively stable lifting platform and the preferred use of hydraulic actuators would even allow the TOMCAT to be used to compensate for tidal rise and fall. Dependent cables attached to the central deck 130 or to a winch or crane 313 upon the vessel can be used to raise or lower loads towards a bottom surface of a water body, useful when salvaging lost containers.

FIGS. 2*a-c* show as perspective views a more realistic embodiment of the TOMCAT, including a bridge deck 202 connecting between the two hulls 101*a* and 101*b*. This version provides an enclosed cabin 201 at the stern of the vessel—actually shown here as two separate spaced-apart cabins in case a stepped mast of a yacht being serviced must be placed in between the two halves at the gap 210. FIG. 2*d* shows a port-side view of a fixed-orientation deck 202 with cabin 201, slidably attached to both of two aft catamaran hulls 207 at linear joint 205, allowing a controlled amount of inwards and outwards movement within at least a defined range. It is likely that a screw and nut mechanism would be used for the linear movement.

FIG. 2A shows a raised-deck configuration with deck 130 above the water surface, FIG. 2*b* shows a just-submerged configuration likely to provide the least draught, and FIG. 2*c* shows a deeply immersed deck suitable for receiving a monohull vessel for lifting, as part of a hull maintenance programme. Again, a series of hydraulic piston actuators 115*a*, 115*b* are provided in order to cause the beams traversing joints 120*a*, 120*b* to rotate and thereby cause lifting or lowering of the deck.

It will be appreciated that the principles as herein disclosed of the TOMCAT can be scaled up to lift bigger loads by one or more of: (a) using more actuators 115 of the same rating, on more sets of beams 110 in order to multiply the total lift, (b) using a ratchet mechanism and repetitive actuator action, as is well know for hydraulic jacks, or (c) using larger actuators and, of course, sufficient static buoyancy. At this time, the inventor has planned a 30 meters craft (hull length). The inventor has calculated that a vessel of over 10,000 tonnes displacement could be lifted in the absence of conventional dry-dock facilities using several scaled-up TOMCATS; two as described in FIG. 2 each rated at for example 4,000 tonnes displacement at each end of the vessel and another, superstructure-free one in the middle.

A number of arrangements of mechanical lifting mechanisms can be provided within the overall concept of a catamaran having a mechanically liftable and lowerable deck. FIG. 2*d* is a side elevation view of a vessel rather like that of FIG. 2*c*. Four sets of lifting beams are shown in this Example for support of deck 130. No hydraulic actuators are shown because in this version the phenomenon as previously described of a rotating pair of hulls is utilised. The aft portion 207 of each hull is connected to the forward portion (bow 204) by a pivoted joint 206. The aft portion 207 of each hull is connected across the bridge 202 to the aft portion of the other hull, through a sliding joint 205 that allows transverse motion of the bridge supports 211 relative to the bridge 202 supporting cabin assembly 201. Those joints and bridge 202 prevent the aft hulls from rotating, which conveniently allows propulsion machinery driving propeller(s) 208 to be included inside the or each aft hull. For lifting purposes, a torque is applied to both shafts 206 joining the forward and aft hulls by appropriate actuators operating over a total range of perhaps 100 degrees. The series of pivot joints at 120*a*, 120*b*; in this case not having local actuators, are forced to twist since beams 110 are rigidly attached. An appropriate actuator may employ a hydraulic motor and planetary gearbox located inside and fixed to the aft hull to apply the required torque. This machinery is better protected from salt water and damage.

In another variation, a central shaft through each hull may also emerge through a seal and maintain a bow section in a constant attitude even though the majority of the hulls rotate. Other solutions, such as use of winches wire or other ropes, and pulleys will be apparent to those experienced in this area.

A design wherein both hulls are attached by a sliding joint or joints at the aft section only could be criticised for lack of strength between the bows, required to maintain integrity in heavy cross-seas. Accordingly, a rigid beam may be carried on board and fixed in place between the hulls across the forward deck when the TOMCAT is in transit.

Any size of TOMCAT is possible. A 30 m ocean-going size is preferred, with a lift to 500 tons and speed in good conditions of up to 24 knots. It is indicatively powered by hydraulic fluids pumped by a 200-500 kW diesel engine, which may be derived from two engines if more reliable or convenient. For propulsion, the engines may directly drive separate propellers, or one engine may drive two hydraulic motors for the two propellers, or drive one pump that creates two water jets; one for each hull.

If desired, locking means (not shown) are used to securely hold lifting floats and fixed floats in a relative orientation.

For example, a locking pin (not shown) could be passed between hull 101*b* and aft hull 207, preventing relative rotation of the joined floats.

The scope of this invention includes provision of service tanks within the hulls or within the deck, or by means of an adjacent floating containment bladder, for holding cleaning liquids and for holding contaminated water; perhaps water that has been used for scraping marine growth off hulls when maintaining a vessel. The TOMCAT deck is preferably provided with effluent retention means in the form of a draining structure, apertures and pumping means to an internal tank, since regulatory authorities are increasingly concerned about pollution.

The TOMCAT may be constructed from any suitable material. Aluminium alloy is preferred for a good balance between cost and durability. Since this marine lift is comprised of several mechanically linked sections; for instance two hulls 101*a* and 101*b*, a deck 130, an array of beams or girders 110, and pivotally attached actuator apparatus 115, it is relatively easy to disassemble the vessel and transport the component parts to another side by road. The estimated reassembly time, first using a crane mounted on a truck and then self-assembly using a "HIAB" type crane that comprises part of the TOMCAT, is about 6 hours. Maximum speed at sea may be from about 16 knots to 40 knots, depending on engine power. Nevertheless, it is capable of adequate speeds when self-powered, by propellers or by water jet means such as a "Hamilton" jet drive.

Example 2

Recovery of Floating Oil

Many maritime disasters either involve or comprise oil spills of raw or processed or stale petroleum products, some of which are intentional such as flushings from tankers. As is well known to those versed in maritime disaster management, actual oil spill conditions are widely variable. Sea conditions (sea, wind, wave, current, contaminants) and oil conditions (amount, composition, consistency, volume, dispersal and combustion) will vary. All responsible maritime authorities seek to dispose of the spilt oil as quickly and effectively as possible. Although this specification addresses oil spills in particular, other surface contamination may be recovered. The following description is not, as yet based on direct experience.

In event of an oil spill the inventors propose to take a TOMCAT from its routine harbour work such as servicing and maintenance of yachts, attach equipment as described below to handle nominally (and without limitation) 6000 tonnes a day of oil, and send it to the site of the spill. That routine harbour work means that the crew or crews need little or no extra training, and specialist training is available from several overseas facilities. The vessel will have been a self-supporting business unit rather than one that drains funds from a limited supply. The attached equipment may be novel, or may be commercially available oil spill recovery equipment.

The TOMCAT provides the extra stability of a catamaran such as if sea conditions are rough. A TOMCAT provided with oil spill collection apparatus is shown in action in FIG. 3. The vessel preferably approaches an oil spill 302 (or the like) from down wind and facing the spill which may have already been marked with buoys or by use of FIR radar as is known in the art. The two hulls 101*a* and 101*b* of the catamaran are bridged by a wheelhouse or cabin 201 that is supported as previously described in FIG. 2 above the hulls. Note the hydraulically driven cranes 313 (only one is shown), capable of reaching over the rigid yet raisable deck 130.

Figure 4:
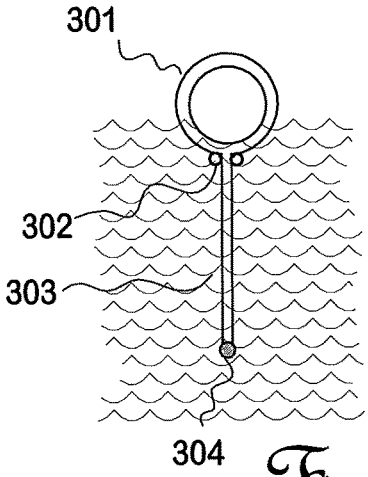
FIG. 4: is a cross-section through an unrolled floating boom.
Figure 5:
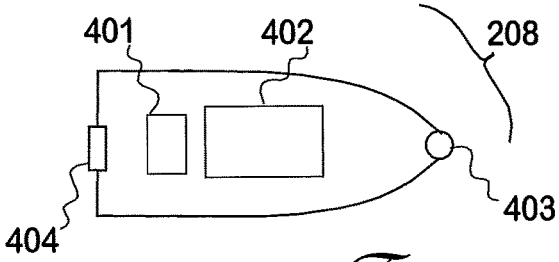
FIG. 5: is a plan diagram of a tug according to the invention.

Proposed spill-handling equipment, included in order to illustrate this example application of a TOMCAT marine lifting vessel includes:

1) Two reels 309, 310 of flexible boom material 300 for use in containment. The reels are provided with drive motors for takeup of booms, and with boom cleaning accessories such as a pair of rollers to clean the rewound booms of oil. Two such booms are intended to be towed around an entire spill, or a part of the spill, in order to contain a "gulp" or contained amount of sea contamination. The two reels are shown in a partially deployed state. Each reel holding a rolled boom is located inside the bows of the TOMCAT. The inventor prefers not to use a rigid boom mounted on each bow of the TOMCAT, since the relative motion is incompatible with even a moderate sea.
2) The boom is made of a smooth-surfaced oil-resistant artificial rubber, bearing in mind that easy cleaning is desirable. An oil-repellent coating may be desirable. Details of one type of inflatable flexible boom are described here, with reference to FIG. 4. Each boom includes an indefinite length of air-dilatable float 301, a flexible pressure pipe 302 and a rope or hawser for taking tension along the length of the boom. 304 indicates a segmented weight that maintains the preferred hanging "curtain" 303 in a downwardly extended orientation within the sea. Preferably the skirt 303 extends a substantial distance—perhaps 1 meter or more—down into the sea in case oil escapes beneath as it will tend to do in disturbed seas or when the oil has become tightly contained.
3) Each float 301 is provided with an air inlet and an air overpressure valve, both preferably at the tug end, so that in a simple operating mode maintenance of buoyancy simply involves supplying enough air to maintain an overflow at the overpressure valve (not shown) and distend the float while the boom is pulled from the spool 309 or 310.
4) Two tugs 307, 308 (see below, and see also FIGS. 4 and 5) are carried on board to the site of the spill. The unmanned, remotely controlled tugboats are driven by remote, wireless control that originate from the wheelhouse or cabin 201 of the TOMCAT.
5) Equipment is provided for dealing with collected oil. One or more skimmers 312, 315 mounted upon the deck, are preferably (for example) "Lamor" brand stiff-brush "Minimax (LMM) skimmers, 1720 mm wide, available from Lamor Corporation, Urakoitsijantie 12, 06450 Porvoo, Finland. That type has a capacity of 30 cubic meters per hour and consumes 4 kW of hydraulic or electric power. Although this technology is already well-developed, it would benefit from mounting upon a variable-height TOMCAT deck that can even be submerged so that the skimmer intake is best aligned with the surface of the sea. Skimmers typically separate out 95% of the water from their intake.
6) One or more powerful pumps 314 capable of forcing even viscous oil collected by the skimmer or skimmers into the bladders through a flexible conduit (not shown) which is linked to the hawser(s) 315 that tows the bladder or bladders.
7) Floating closed containers 311*a*, 311*b* which are preferably bladders of a flexible synthetic rubber material for holding separated oil. These are to be collected by recovery vessels and towed to a disposal facility. More water may be separated within the bladder and released through a valve built into the bladder. See below.

8) Navigation devices, communications gear, oil-spill detection devices such as radar, disposable buoys for marking a located oil patch, and crew support facilities are also carried by the TOMCAT, which may be fitted to receive helicopter loads.

Figure 6:
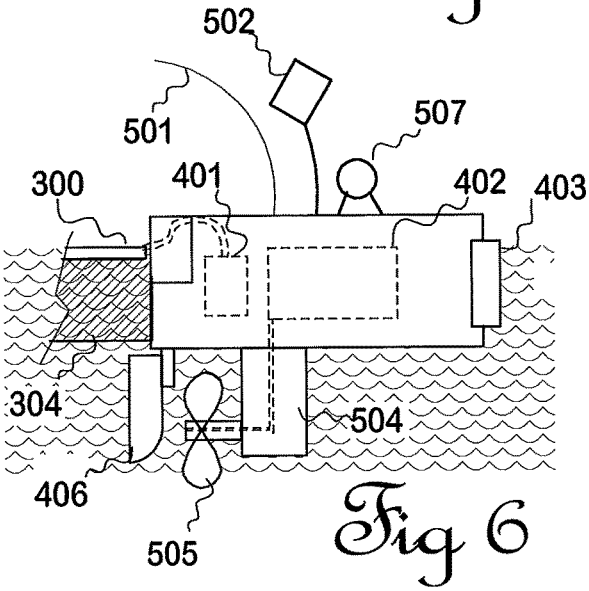
FIG. 6: is an elevation schematic diagram of a tug.

Two unmanned and remotely controlled, self-righting tugboats are carried on the TOMCAT until needed for boom deployment. One position is indicated by dashed silhouettes forward of the liftable deck. Each boom will be towed through the sea by one of the unmanned tugs 307, 308 which are remotely controlled from the wheelhouse 201, especially since conditions around or in an oil slick are hostile to human life. A swimmer could not float above the oil and there is a fire hazard, and extensive fumes; also, an unmanned tugboat is disposable. Each tug includes radio control means 501 to control the propeller speed, the rudder 406 direction, boom inflation, and tug bow coupling 403. Each tug includes an electric or diesel engine 402 to drive a deeply mounted propeller 405. The deep propeller is preferred in order to reduce agitation of the surface. It is preferable that the tugs do not churn the surface and disturb floating material. Alternatively, the tugs may have one, or two counter-rotating, relatively large and slow propellers supported from a downwardly directed drive shaft or may be powered by a "Hamilton" jet drive with a relatively deep jet exit. The tug may carry bottled air or oxygen for reliable combustion within its diesel motor 402, because local fumes may exist. Each tug will carry bottled inert gas or a compressor 401 to inflate the booms. Each tug travels along a course perhaps as indicated by the dashed line in FIG. 3 in order to enclose an area of water surface with towed booms. The two tugs make contact to enclose a space and by boom retraction or other methods bring the spill or at least the enclosed part of it toward skimmers on the catamaran. During reeling-in, air is released from the boom at the tug through the over-pressure valve. 302 indicates an included rope that takes longitudinal tension as the boom is deployed. The preferred length of one unit of flexible boom remains to be established, as does the possibility of coupling an end of one boom to another so that each "gulp" entraps a larger surface as defined by the perimeter of a space inside the booms. Each tug as shown in the diagram, FIG. 6, preferably has a vertical profile at its bow and at its stern so that they can come close together and form part of a wall around a slick.

Each tug has a lifting ring 507 for launching or retrieval by the crane 313, and is fully enclosed and buoyant. A possible drop in effective buoyancy when the tug is immersed in a thick oil spill must be allowed for. The radio control means (using aerial 501) would report back to the controlling person on the TOMCAT useful information such as remaining fuel, boom tension, boom internal pressure, Cartesian position information such as from a GPs, and optionally a closed-circuit view from an on-board steerable camera which is preferably one sensitive to particular bands of infra-red light in order to detect floating oil in relation to water. (An advantage of this design is that the tugs can be used to hunt for oil under remote control and might not be joined to a boom during that process). A radar reflector 502 helps locate the tugs in darkness, or if they should break loose and lose power. A radar transponder may be used to identify each tug.

In one mode of use each tug pulls the boom forward and to one side of the respective bow, so that both booms form a wide "V" towards the oil. Then the oil is brought by current, wind or slow ahead motion of the TOMCAT into the space between the hulls from where it is skimmed and forced into a floating storage bladder towed behind the TOMCAT.

In another mode of use each tug is steered so that it encircles the spill with the towed and inflated booms, culminating in the two tugs becoming joined together and sealing the oil in between the two in-contact tugs.

When the tugs 307, 308 are steered under remote control in order to make bow contact with each other while surround at least part of the oil spill 302 they may become coupled together using apparatus 403 which may comprise a mechanical interlock or coupling, or use an electromagnetic lock which can be remotely controlled. Conditions may instead require the tugs to define an open-ended "V" facing the oil spill, and surface wind or forward motion of the TOMCAT presents oil to the skimmer apparatus.

The tugs may themselves be of catamaran or twin-hulled design for better stability and interlocking effect. This option is preferable, since the tugs may be subjected to sideways torques while towing booms.

After the oil spill 302 has been encircled, each boom is reeled back on board the catamaran. A pair of take-up rollers adjacent each spool 309, 310 are pressed against each other in order to squeeze off any oil in contact. Reeling in the boom has the effect of dragging the tugs back, and the catamaran may advance slowly into the oil spill at this time. The act of rolling up the inflatable booms, which is carried out under close control so that optimised collection occurs, will draw floating materials within toward the deck of the TOMCAT, in between the two hulls. The TOMCAT deck is inherently raisable or lowerable with respect to the sea surface by hydraulic controls for best oil collection and separation effect by a most appropriate method. Alternatively the TOMCAT may sail into the wind and collect the oil into a space between open booms.

Any material trapped by the booms is now accessible to the proprietary skimmers 312, 313 which can be lifted up or down by deck height adjustment as required. Two skimmers side by side are shown here, but the actual arrangement is dependent on availability and convenience. It may be preferable to have a third skimmer behind to catch spilt oil. A person may be stationed near the skimmer intake to pick out oiled birds, marker buoys and the like. The skimmed oil is pumped by a proprietary hydraulically driven pump 314 capable of pumping 50 cubic meters of oil per hour into a conduit leading to an oil disposal tank. The last portion of the retrieved oil spill when the tugs are nearly home may be collected into a mobile skimmer held on the portable crane 313, or collected manually, or collected as part of the next "gulp".

For optimised handling of a quantity of oil, the oil disposal tank preferably comprises proprietary floatable bladders 311*a* and 311*b*. Such bladders can be filled while being towed behind the catamaran on a hawser 315, and when full, disconnected and taken away by any suitable small to medium boat to an on-shore disposal site. Fresh bladders are stored on the catamaran or in one of the hulls, and can be replaced by a helicopter for example if required. The nominally intended amount of 6000 tonnes a day of collected oil would require a number of bladders.

Variations

A "front-end loading" TOMCAT configuration has been described. Alternatives include rear-end loading, central placement of control cabins, and placement of control cabins on a separate vessel tied to the TOMCAT by a wireless link, by cables, or by hydraulic hoses.

Results and Advantages

The inherent floating stability of a catamaran design in combination with a versatile lifting mechanism provides more stable and predictable flotation that either a single hull vessel or one reliant on displacement of water by air for buoyancy. Static buoyancy floats which remain mostly above a water surface serve as the catamaran hulls. The lifting mechanism has a range exceeding typical tidal rise and fall and with suitable design is able to pass beneath a launch or yacht hull and rise up to lift the hull from the water. The ability to raise or lower the entire deck in relation to the buoyant pontoons is an advantage over the prior art which provides only a hinged, lowerable extension of a bridging deck, not much different from many vehicle ferries. This aspect employs strong hydraulically driven pivoted arms and confers much of the versatility of the catamaran. The catamaran has many uses beyond oil spill as in Example 2, providing economic advantages over a single-purpose vehicle. Applications include: a self-propelled, buoyant dry dock, simulating many of the uses of a slipway; a rescue vessel such as for ferry accidents; delivery of vehicles and cargo onto islands; a carrier for hovercraft; a stable floating crane (either over one side or centrally even through a modified deck).

A particular advantage of the invention is that the TOMCAT and its crew or crews can be usefully employed during the periods in between oil spill events or training sessions by using the TOMCAT as, for example, a floating dry dock to lift small to medium vessels for hull cleaning. Maritime services provided on a fee per service basis include, for example: (1) lifting vessels of up to 500 tonnes for anti-fouling treatments, including effluent capture from on-deck drainage to an attached or floating containment bladder, (2) providing a platform for marine surveying, (3) providing a platform for engineering works, including bridge building, where the raisable deck allows compensation for tidal movement, (4) water decontamination, (5) salvage, in order to make the provision of sufficient oil spill recovery vehicles financially viable without excessively taxing users such as commercial vessels and drilling rig operators.

As soon as an alarm is raised the vessel being cleaned is returned to the water, and the TOMCAT loads appropriate equipment. The TOMCAT is particularly appropriate for oil recovery because it has the stability and mobility of a catamaran and the ability to raise or lower its working deck for alignment of oil skimmer devices in relation to the water surface according to immediate conditions such as the fluidity of the oil, wave height, and currents.

What is claimed is:

1. A marine lifting vessel or catamaran comprising:

two buoyant hulls, each hull being provided with static buoyancy;

a rigid working deck having a top, an underneath, two sides, a bow aspect and a stern aspect, the deck comprising hull beams;

a plurality of intermediate jointed beams arranged in a parallel array and securing a first of the two hulls to a first side of the deck, and securing a second of the two hulls through an opposite, second side of the deck, the deck being movably and symmetrically supported along each of the first and second sides from an adjacent one of the first and second hulls by the plurality of intermediate jointed beams, each intermediate jointed beam being comprised of a hull beam and a deck beam pivotally joined together at their adjacent ends and having a substantially horizontal axis of rotation, each intermediate jointed beam thereby forming a lifting joint on one of the first and second sides of the deck; the non-adjacent ends of each intermediate jointed beam being fixedly attached to one of the hulls and to the deck respectively; and wherein each lifting joint shares a common axis of rotation with the joints of other intermediate jointed beams; and an actuator provided for each lifting joint to, in use, forcibly change an angle between the hull beam and the deck beam at the lifting joint; all actuators being controlled so that, when in use, a height of the rigid deck in relation to a water line can be altered by forcibly causing the angles of a plurality of the lifting joints to change; thereby either lifting the deck higher above the water line, or lowering the deck to or below the water line.

2. A marine lifting vessel or catamaran as claimed in claim 1, wherein each actuator comprises at least one hydraulic piston operable in both extension and in retraction directions that is connected by means of a rigid side arm set off both horizontally and vertically from the pivoting joint, so that when in use the piston can exert torque around the pivoting joint through at least 90 degrees of rotation.

3. A marine lifting vessel or catamaran as claimed in claim 1 wherein an aft portion of each hull is pivotally mounted by means of a shaft in line with and fixed to the forward remainder of each hull, the aft portion of each hull is prevented from rotation by a non-rotating, bridging member linking each hull to the opposite hull yet permitting relative sideways movement to occur, and in order to provide the deck with a lifting or a lowering force both shafts are caused to rotate each in an opposite direction with respect to the aft section by a motor within each aft section coupled to each shaft so that, when in use, the forward hulls are forced to rotate through a defined angle and the deck and hull beams are forced to follow.

4. A marine lifting vessel or catamaran as claimed in claim 3 wherein the bridging member supports a non-rotating control deck.

5. A marine lifting vessel or catamaran as claimed in claim 4, wherein the bridging member comprises a foundation on which to build a superstructure and from which to support powered propulsion means.

6. A marine lifting vessel or catamaran as claimed in claim 3, wherein the catamaran is provided with accessories capable of collecting floating materials from a surface of a body of water and of placing said floating materials into a container for later disposal; and wherein the capability of the catamaran for varying the height of the deck in relation to the waterline provides an enhanced capability for collection of said floating materials, and wherein the floating materials include spilt petroleum products.

7. A marine lifting vessel or catamaran as claimed in claim 6 wherein the catamaran is provided with daughter tug vessels or tugs capable of pulling a floating boom around an area on a surface of the body of water under remote control so that said floating materials may be contained; each tug including an engine, propeller and rudder, and means for receiving control signals by wireless in order that the tugs are remotely controllable.

8. A marine lifting vessel or catamaran as claimed in claim 6 wherein the catamaran is capable of being disassembled into component parts including hulls or hull segments, linking beams, a rigid deck or parts thereof, in order that it may be transported by land transport vehicles and reassembled adjacent a launch site, including but not limited to marine salvage and/or an oil spill.

9. A marine lifting vessel or catamaran comprising:

first and second hulls, the first and second hulls each being buoyant hulls provided with static buoyancy;

a rigid working deck having a top, an underneath, two sides, a bow aspect and a stern aspect;

a plurality of intermediate jointed beams arranged in an array securing the first hull to the second hull through the deck, each of the first and second hulls being movably and symmetrically supported along each side from an adjacent one of the first and second hulls by the plurality of intermediate jointed beams, each intermediate jointed beam being comprised of a hull beam and a deck beam pivotally joined together at adjacent ends to define a pivoting joint, and having a substantially horizontal axis of rotation, each intermediate jointed beam thereby forming a lifting joint, non-adjacent ends of each intermediate joined beam being fixedly attached to the hull and to the deck respectively, wherein each lifting joint shares a common axis of rotation with the lifting joints of other intermediate jointed beams; and actuators arranged at each lifting joint, in use the actuators forcibly changing an angle between the hull beam and the deck beam of each intermediate jointed beam, the actuators being controlled so that, when in use, a height of the rigid deck in relation to a water line can be altered by forcibly causing the angles of a plurality of the joints to change, thereby either lifting the deck higher above the water line, or lowering the deck to or below the water line, and wherein an aft portion of each hull is pivotally mounted by a shaft in line with and fixed to the forward remainder of each hull, the aft portion of each hull being prevented from rotation by a non-rotating, bridging member linking each hull to the opposite hull while permitting relative sideways movement to occur, and in order to provide the deck with a lifting or a lowering force, both shafts are caused to rotate each in an opposite direction with respect to the aft section by a motor within each aft section coupled to each shaft so that, when in use, the forward hulls are forced to rotate through a defined angle and the deck and hull beams are forced to follow.

10. A marine lifting vessel or catamaran as claimed in claim 9, wherein each actuator comprises a hydraulic piston operable in both extension and in retraction directions, the hydraulic piston connected by a rigid side arm set off both horizontally and vertically from the pivoting joint, so that when in use the piston can exert torque around the pivoting joint through at least 90 degrees of rotation.

11. A marine lifting vessel or catamaran as claimed in claim 9, wherein the bridging member supports a non-rotating control deck.

12. A marine lifting vessel or catamaran as claimed in claim 11, wherein the bridging member comprises a foundation on which to build a superstructure and from which to support powered propulsion means.

13. A marine lifting vessel or catamaran as claimed in claim 9, wherein the catamaran is provided with accessories capable of collecting floating materials from a surface of a body of water and of placing said floating materials into a container for later disposal, and wherein the capability of the catamaran for varying the height of the deck in relation to the waterline provides an enhanced capability for collection of said floating materials, and wherein the floating materials include spilt petroleum products.

14. A marine lifting vessel or catamaran as claimed in claim 13, wherein the catamaran is provided with daughter tug vessels or tugs capable of pulling a floating boom around an area on a surface of the body of water under remote control so that said floating materials may be contained; each tug including an engine, propeller and rudder, and means for receiving control signals by wireless in order that the tugs are remotely controllable.

15. A marine lifting vessel or catamaran as claimed in claim 13, wherein the catamaran is capable of being disassembled into component parts including hulls or hull segments, linking beams, a rigid deck or parts thereof, in order that the component parts may be transported by land transport vehicles and reassembled adjacent a launch site, including but not limited to marine salvage and/or an oil spill.

16. A marine lifting vessel or catamaran comprising:

first and second hulls, the first and second hulls each being buoyant hulls provided with static buoyancy;

a rigid working deck having a top, an underneath, two sides, a bow aspect and a stern aspect;

a plurality of intermediate jointed beams, a first sub-set of the intermediate jointed beams securing the first hull to a first side of the deck, and a second sub-set of the intermediate jointed beams securing the second hull through an opposite, second side of the deck, the deck being movably and symmetrically supported along each of the first and second sides from an adjacent one of the first and second hulls by the plurality of intermediate jointed beams;

each intermediate jointed beam being comprised of a hull beam and a deck beam pivotally joined together at adjacent ends along a respective one of the first and second sides of the jack to form first lifting joints along the first side of the deck and second lifting joints along the second side of the deck, each intermediate jointed beam having a substantially horizontal axis of rotation, each intermediate jointed beam further being attached to one of the first and second hulls and to the deck, wherein each lifting joint shares a common axis of rotation with the lifting joints of other intermediate jointed beams; and actuators arranged with each lifting joint, in use the actuators forcibly changing an angle between the hull beam and the deck beam of each intermediate jointed beam, the actuators being controlled so that, when in use, a height of the rigid deck in relation to a water line can be altered by forcibly causing the angles of a plurality of the lifting joints to change, thereby either lifting the deck higher above the water line, or lowering the deck to or below the water line.

17. A marine lifting vessel or catamaran as claimed in claim 16, wherein each actuator comprises a hydraulic piston located below the deck and operable in both extension and in retraction directions, the hydraulic piston connected by a rigid side arm set off both horizontally and vertically from the lifting joint, so that when in use the piston can exert torque around the pivoting joint through at least 90 degrees of rotation.

* * * * *